US008955516B2

(12) United States Patent
Gaffney et al.

(10) Patent No.: US 8,955,516 B2
(45) Date of Patent: Feb. 17, 2015

(54) FACE SEALS FOR RESPIRATORS AND METHOD OF MANUFACTURING RESPIRATORS

(75) Inventors: Shaila Gaffney, Charlotte, NC (US); Judge W. Morgan, III, Oakboro, NC (US); Troy Baker, St Asaph (GB)

(73) Assignee: Scott Technologies, Inc., Boca Raton, FL (US)

( * ) Notice: Subject to any disclaimer, the term of this patent is extended or adjusted under 35 U.S.C. 154(b) by 981 days.

(21) Appl. No.: 12/420,385

(22) Filed: Apr. 8, 2009

(65) Prior Publication Data

US 2010/0258131 A1 Oct. 14, 2010

(51) Int. Cl.
*A62B 18/02* (2006.01)
*A62B 18/08* (2006.01)

(52) U.S. Cl.
CPC ..... *A62B 18/08* (2013.01)
USPC ..... 128/206.24; 128/206.21

(58) Field of Classification Search
CPC ..... A61M 16/06; A61M 16/0616; A61M 16/0605; A62B 9/00; A62B 18/08
USPC ..... 128/201.22–201.25, 201.27, 128/206.12–206.14, 206.21, 206.24, 128/206.23, 206.28, 207.13
See application file for complete search history.

(56) References Cited

U.S. PATENT DOCUMENTS 1,310,825 A * 7/1919 Ganzer ..... 128/204.26
2,133,699 A * 10/1938 Heidbrink ..... 128/206.24
2,371,965 A * 3/1945 Lehmberg ..... 128/205.25
2,936,458 A * 5/1960 Luisada ..... 2/435
3,330,273 A * 7/1967 Ray ..... 128/206.26
3,330,274 A * 7/1967 Ray ..... 128/206.26
4,029,092 A 6/1977 Morgan
4,069,516 A 1/1978 Watkins, Jr.
4,083,065 A 4/1978 Warncke
4,167,185 A 9/1979 Lewis
4,253,328 A * 3/1981 Pasternack ..... 73/40.7
4,378,011 A * 3/1983 Warncke et al. ..... 128/204.26
4,574,799 A * 3/1986 Warncke ..... 128/206.24
4,689,837 A * 9/1987 Bolle ..... 2/440
H397 H 1/1988 Stark
4,739,755 A 4/1988 White et al.
4,905,683 A * 3/1990 Cronjaeger ..... 128/202.22
5,069,205 A * 12/1991 Urso ..... 128/201.24
5,322,059 A * 6/1994 Walther ..... 128/205.23

(Continued)

FOREIGN PATENT DOCUMENTS

EP 1582231 5/2005
GB 2143136 2/1985
WO WO 2006/113321 10/2006

OTHER PUBLICATIONS

PCT International Search Report, 4 pgs.

*Primary Examiner* — Tan-Uyen (Jackie) T Ho
*Assistant Examiner* — Kathryn E Ditmer
(74) *Attorney, Agent, or Firm* — Wyatt B. Pratt

(57) ABSTRACT

A respirator includes a mask having a body extending between a front edge and a rear edge, and a face seal extending inward from the body. The face seal has a first wall extending from the body and a second wall intersecting with the first wall at a sealing land. The sealing land is configured to contact a user's face to form a continuous circumferential seal. The face seal is folded over such that the first wall and the second wall both extend away from the sealing land in a common direction. Optionally, the face seal may be U-shaped.

19 Claims, 6 Drawing Sheets

(56) References Cited

U.S. PATENT DOCUMENTS

| | | | |
|---|---|---|---|
| 5,479,918 | A | 1/1996 | Petit |
| 5,499,624 | A | 3/1996 | Kruger et al. |
| 5,738,094 | A | 4/1998 | Hoftman |
| 6,016,804 | A | 1/2000 | Gleason et al. |
| 6,035,852 | A | 3/2000 | Hoftman |
| 6,394,091 | B1 | 5/2002 | Giorgini |
| 6,401,716 | B1 | 6/2002 | Sword et al. |
| 6,626,178 | B2 | 9/2003 | Morgan et al. |
| 2006/0225739 | A1 | 10/2006 | Rylander |
| 2007/0163594 | A1 | 7/2007 | Ho |
| 2007/0295335 | A1 | 12/2007 | Nashed |

* cited by examiner

FACE SEALS FOR RESPIRATORS AND METHOD OF MANUFACTURING RESPIRATORS

BACKGROUND OF THE INVENTION

The subject matter herein relates generally to respiratory protection systems, and more particularly, to face seals for respirators and a method of manufacturing respirators.

Numerous types of respirators for respiratory protection systems are known that deliver breathing air and/or filtered breathing air to a user. Such respirators have different performance requirements depending on the circumstances in which the devices are intended to be used. Examples of respirators include self contained breathing apparatus (SCBAs), air purification respirators (APRs), powered air purification respirators (PAPRs), and the like that supply pressurized air or that filter or cleanse ambient air. Certification agencies set forth different requirements, such as fit factor requirements that correspond to assigned protection factors, for different types of respirators to allow users to select appropriate respirators or respiratory protection equipment for the environments they work in, with respect to contaminants and environmental conditions that warrant varying levels of protection.

Respirators typically include a face mask that should properly fit the face of the wearer. The face mask is designed for a particular type of respirator. For example, a face mask for a SCBA may be designed differently than a face mask for an APR or a PAPR. The seal for the face mask may be designed differently for the SCBA than the APR, as the SCBA and APR have different fit factor requirements. The materials of the face mask and/or the seal may be different depending on the type of respirator. As such, a user that must operate in different types of environments to perform different duties may need different face masks for each different respirator. It is costly for users to maintain multiple masks for each type of respirator so that the user can perform different duties. Additionally, having multiple masks may contribute to a logistical burden for the users and problems in inventory control and maintenance costs in that annual fit tests drive the cost of implementing and supporting respiratory protection programs. Furthermore, having different designs for a family of respirator is costly in terms of design costs, tooling costs, manufacturing costs, and the like.

Seal of the face mask is an important feature affecting fit factor. One area of the face mask that is difficult to maintain seal with the user's face is under the user's chin. For example, movement of the user's mouth, such as during talking, causes the user's face to move relative to the seal, which may break the seal. Additionally, because it is inconvenient to attach a strap near the chin area of the mask, the face mask tends to move away from the user's chin area, such as when the user looks down and the weight of the mask pulls the mask away from the user's face. Additionally, some known face masks support canisters or other components that tend to pull the face mask away from the user's face.

Comfort in the fit of the face mask to the face also affects fit factor because if the face mask is not comfortable to wear the face mask will bother and distract the user or may cause painful "hotspots" on the wearers' faces, contributing to undue physiological burden. Additionally, the user may improperly don and tighten the face mask in an attempt to avoid such discomfort. Face masks are typically made in only a very limited number of shapes and sizes, intended for use with a wide variety of facial shapes and sizes in the user population. The varying anthropometric accommodation necessary to support the user population of human faces makes it difficult to provide a mask which will comfortably fit a large population of users.

A need remains for a respirator that is comfortable to wear. A need remains for a respirator that has effective seal of the face mask to the user's face. A need remains for a respirator that is cost effective. A need remains for a facemask with a face seal that meets the requirements for different applications, such as SCBA APR, PAPR and other applications.

BRIEF DESCRIPTION OF THE INVENTION

In one embodiment, a respirator is provided that includes a mask having a body extending between a front edge and a rear edge, and a face seal extending inward from the body. The face seal has a first wall extending from the body and a second wall intersecting with the first wall at a sealing land. The sealing land is configured to contact a user's face to form a continuous circumferential seal. The face seal is folded over such that the first wall and the second wall both extend away from the sealing land in a common direction.

Optionally, the face seal may be U-shaped having an open side and a closed side, with the open side being positioned outward with respect to the closed side. The face seal may be cantilevered from the body with the first wall extending inward from the body to the sealing land and with the second wall extending from the sealing land outward toward the body. The first and second walls may be spaced apart from one another to form a seal cavity generally bounded by the first and second walls, the sealing land and the body. Optionally, the face seal may be configured to be deformed when sealing against the face. The sealing land may be oriented generally parallel to the body when sealing against the face, the first wall may extend from a front end of the sealing land toward the body and the second wall may extend from a rear end of the sealing land toward the body. Optionally, the respirator may include a chin cup extending from at least one of the body and the face seal, where the chin cup has a bottom configured to extend under the chin of the user. The face seal may extend inward from the bottom of the chin cup. The face seal may be rolled upward to form a lip between the chin cup and the face seal, with the interface between the chin cup and the face seal being adapted to capture the chin therein. The face seal may be cantilevered from the body such that the second wall is free from the body. The second wall may be configured to be pressed against the body when the face seal engages the user's face such that the sealing land is supported by both the first and second walls.

In another embodiment, a face seal for a respirator mask is provided that includes a first wall extending inward from the mask, a sealing land, and a second wall extending outward from the sealing land. The sealing land is configured to contact a user's face to form a continuous circumferential seal against the user's face. The sealing land has a front end and a rear end where the front end is positioned forward of the rear end on the user's face. The first wall, sealing land and second wall are integrally formed and define a U-shaped face seal configured to seal against the user's face.

In another embodiment, a method of manufacturing a respirator is provided that includes the steps of forming a mask body configured to be worn by a user and positioning a face seal inward of the mask body. The face seal has a first end and a second end and a sealing land between the first and second ends. The face seal is folded over to define a bulbous shape adapted for engaging the user's face. The method also includes the step of securing the first end to the mask body and allowing the second end to be free from the mask body. The second end is configured to engage the mask body when the mask is worn by the user such that the face seal is supported at two different points along the mask body. Optionally, the method may include the steps of providing a chin cup having a bottom configured to extend along a bottom of the user's chin and securing the chin cup to the face seal such that the sealing land is positioned inward with respect to the bottom of the chin cup.

DETAILED DESCRIPTION OF THE INVENTION

Figure 1:
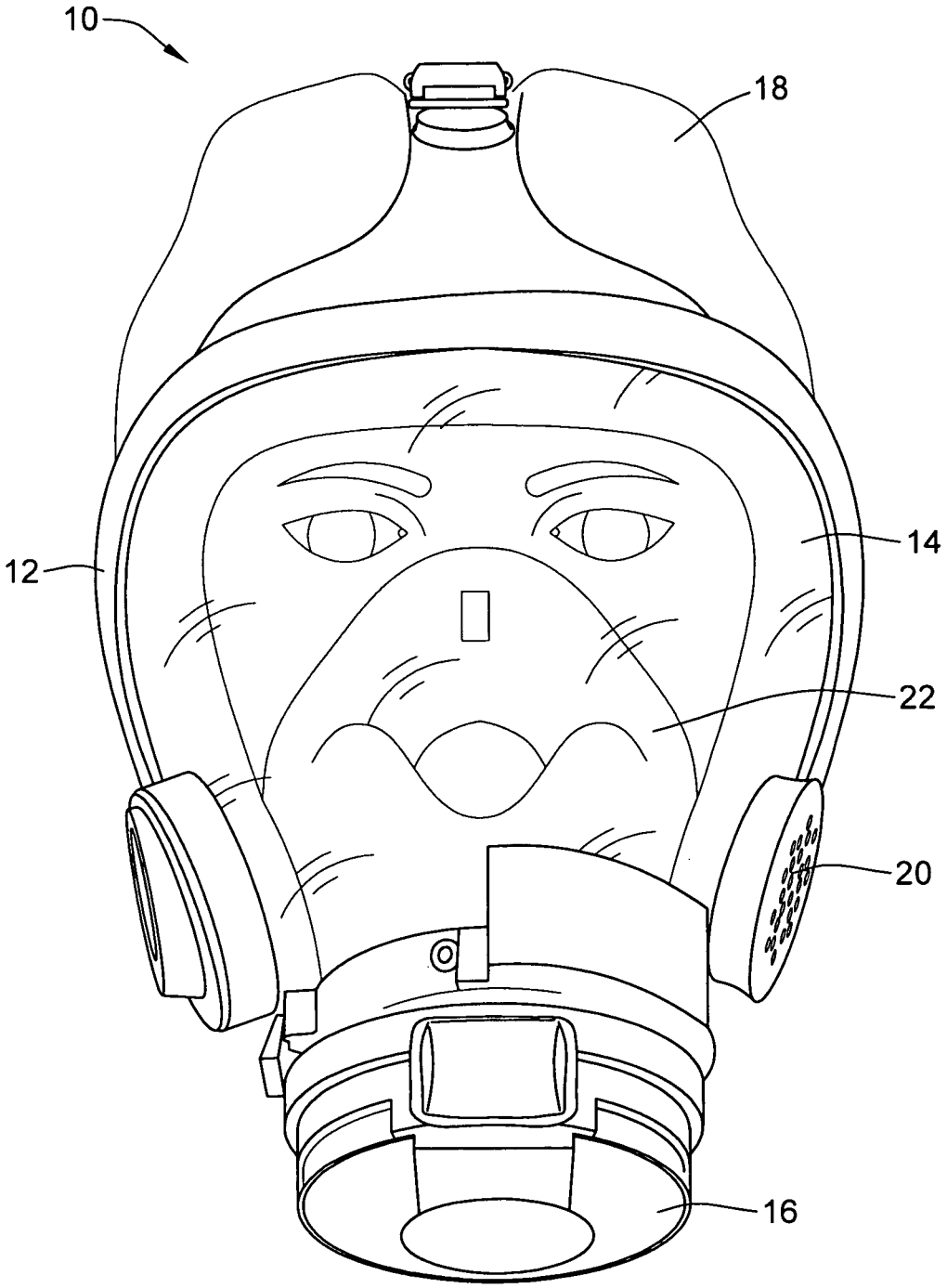
FIG. 1 is a perspective view of a respirator formed in accordance with an exemplary embodiment.

FIG. 1 is a perspective view of a respirator 10 formed in accordance with an exemplary embodiment. The respirator 10 includes a mask 12 holding a lens 14 and an air purifying cartridge 16. The mask 12 is adapted to be secured to a user's face by a head harness 18. The respirator is adapted to provide breathing gas to the user and/or to filter breathing air for the user, which includes air which has been filtered or otherwise treated so that airborne contaminants are removed therefrom. While the mask described herein is a full facemask (e.g., constructed to cover the eyes as well as the mouth and nose), it should be understood that the mask which embodies the subject matter herein may alternatively be a half facemask (e.g., constructed to cover the mouth and nose but not the eyes) or a quarter mask (e.g., constructed to cover the nose and mouth but not extend under the chin), or the mask may be another type of face covering. In addition, while the mask 12 described in connection with the preferred embodiment is constructed for attachment of air purifying cartridges to serve as a respirator, it should be understood that the mask 12 may alternatively be constructed for attachment of hoses for delivering oxygen or other breathable gas, as well as adapters to accept hoses, filters and/or regulators specific to particular duties or to be used in particular environments.

The mask 12 covers the eyes, nose and mouth of a person for protecting the person from airborne contaminants by means of the air purifying cartridges or filters 16. While the mask 12 is shown to have one air purifying cartridge 16 centrally located in front of the user's mouth, it should be understood that the mask 12 could be provided with any number of cartridges 16 and the cartridges 16 may be positioned at any suitable location. Various types of cartridges 16 (some containing gas absorbents and others containing mechanical filters and others containing both) may be interchangeably attached to the mask 12. The mask 12 is fitted for a particular use with the type of cartridge 16 that is suitable for removing the particular contaminants in the environment at the time of use. In an exemplary embodiment, one or more exhalation valves 20 are provided on the sides or at the front of the mask 12. It should also be understood that an exhalation valve may be used, and/or that a separate passageway for exhalation gases may not be required as the gas inlet could be designed to handle the egress of exhalation gases on a part-time basis. In some embodiments, voice enhancement features may be provided on the sides or at the front of the mask for allowing communication when wearing the mask.

The respirator 10 includes a nose cup 22 that surrounds the user's nose and mouth. The nose cup 22 is positioned behind the lens 14. A flow path, such as ductwork or another type of channel, is defined between the cartridge 16 and the nose cup 22 to deliver air to the user. Optionally, the nose cup 22 may be coupled to the lens 14. Alternatively, or additionally, the nose cup 22 may be coupled to the mask 12. In some embodiments, the respirator 10 may be provided without the nose cup 22.

The respirator 10 may be used for any of a number of applications, such as self contained breathing apparatus (SCBA) applications, air purification respirator (APR) applications, powered air purification respirator (PAPR) applications, and the like. In an exemplary embodiment, the same mask 12 may be used by a user for different applications by interchanging the components attached to the mask 12 for delivering or expelling air. For example, by changing the type of cartridge or filter 16, or by attaching a hose to the mask 12, the user may be able to use the respirator 10 in a different environment. The mask 12 provides a seal with the user's face that meets the requirements of more than one category of respirator for convertibility to each of the environments in which the user may embark.

Figure 2:
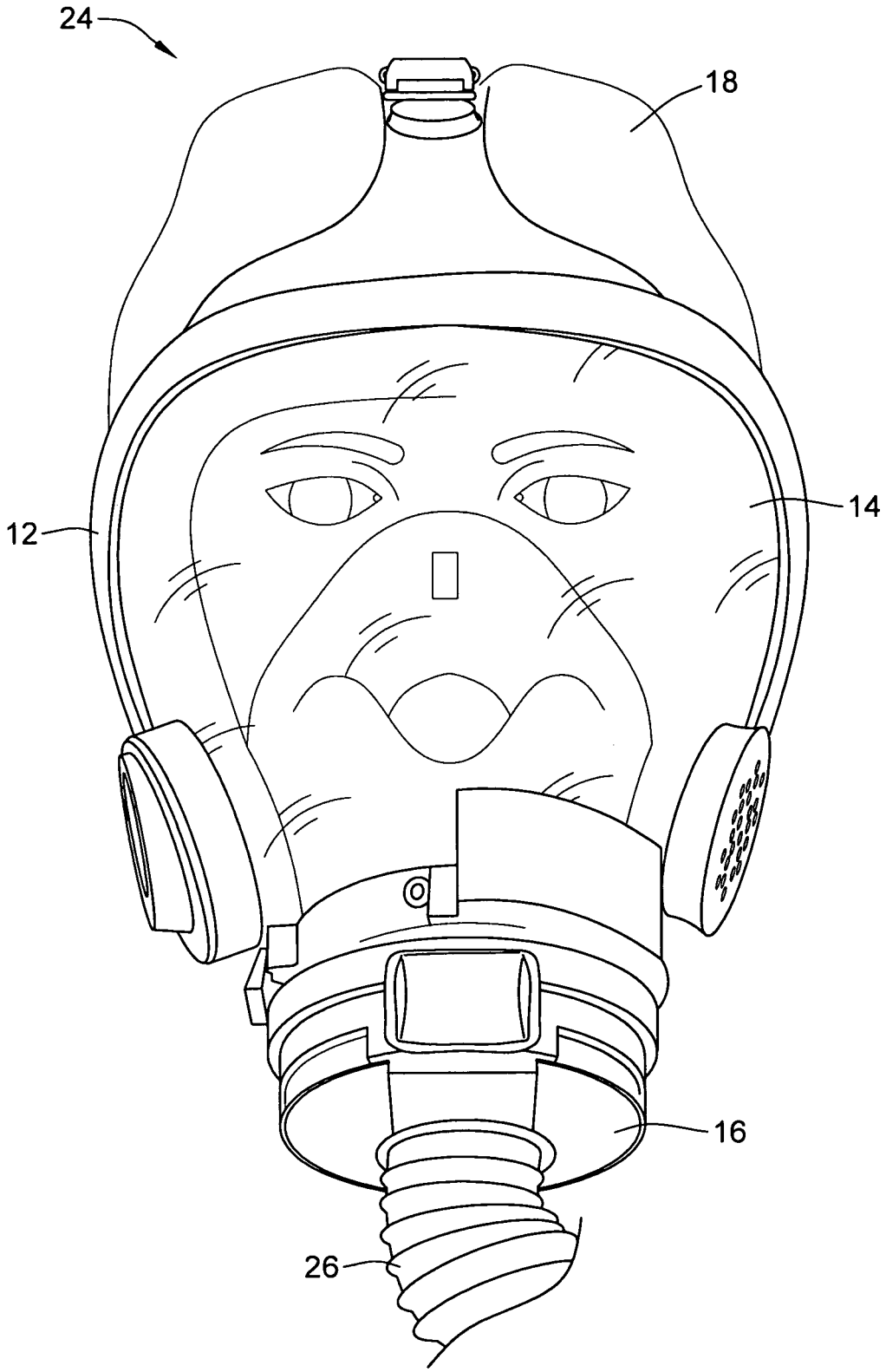
FIG. 2 is a perspective view of an alternative respirator formed in accordance with an alternative embodiment.

FIG. 2 is a perspective view of an alternative respirator 24 formed in accordance with an alternative embodiment. The respirator 24 is similar to the respirator 10 (shown in FIG. 1). The respirator 24 includes the mask 12, the lens 14 and the head harness 18. Rather than using a cartridge 16 (shown in FIG. 1) as is the case with the respirator 10, the respirator 24 includes a hose 26 for delivering oxygen or filtered breathing air. The hose 26 is connected to the mask 12 and/or the lens 14. The other end of the hose may be attached to a powered air purifying blower with filters, to a remote mounted filter, and the like. The hose 26 may attach to the same port of the mask 12 and/or the lens 14 such that the hose 26 may be interchangeable with the cartridge 16.

Figure 3:
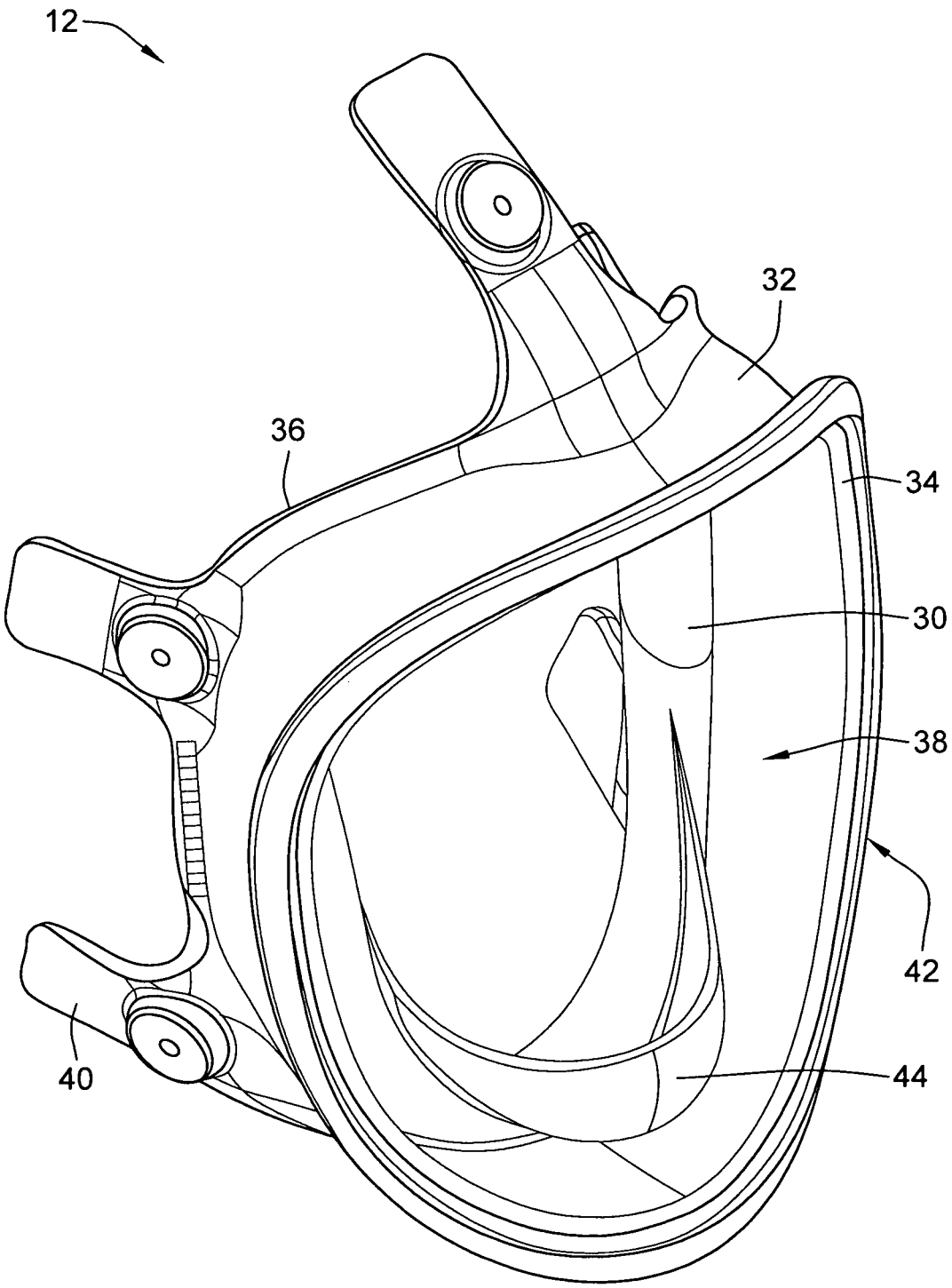
FIG. 3 is an isometric view of a portion of the mask showing a face seal for either of the respirators shown in FIGS. 1 and 2.

FIG. 3 is an isometric view of a portion of the mask 12 showing a face seal 30 for the respirator 10 (shown in FIG. 1). The lens 14, head harness 18 (both shown in FIG. 1) and other components have been removed for clarity. The mask 12 and face seal 30 may be equally adapted for use with the respirator 24 (shown in FIG. 2).

The mask 12 includes a body 32 defining a perimeter of the mask 12. The body 32 may be composed of a suitable soft pliable material, such as a rubber material, for comfortably as well as sealing engagement with the face and/or head of a user. The body 32 may be used in conjunction with the face seal 30 to provide additional sealing with the user. Optionally, the race seal 30 may be secured to the body 32 by being integrally formed with the body 32. For example, the face seal 30 and the body 32 may be simultaneously molded with one another. Alternatively, the face seal 30 may be separately manufactured and coupled to the body 32. In such embodiment, the face seal 30 and the body 32 may be manufactured from different materials having different characteristics. For example, the body 32 may be composed or a more rigid material, such as a plastic material, for defining a donable structure and the face seal 30 may be manufactured from a soft pliable material to accomplish the seal with the user's face.

The body 32 extends between a front edge 34 and a rear edge 36. The body 32 circumferentially surrounds a face receiving chamber 38 that is defined between the front and rear edges 34, 36. A plurality of mounting tabs 40 extend rearward from the rear edge 36. The head harness 18 is secured to the mounting tabs 40. Any number of mounting tabs 40 may be provided. An opening 42 is defined at the front edge 34. The lens 14 is mounted to the body 32 at the opening 42. The face seal 30 extends inward from the body 32 proximate to the rear edge 36.

In an exemplary embodiment, the mask 12 includes a chin cup 44 that receives the chin of the user. The chin cup 44 is coupled to the face seal 30. The chin cup 44 may be additionally, or alternatively, coupled to the body 32.

Figure 4:
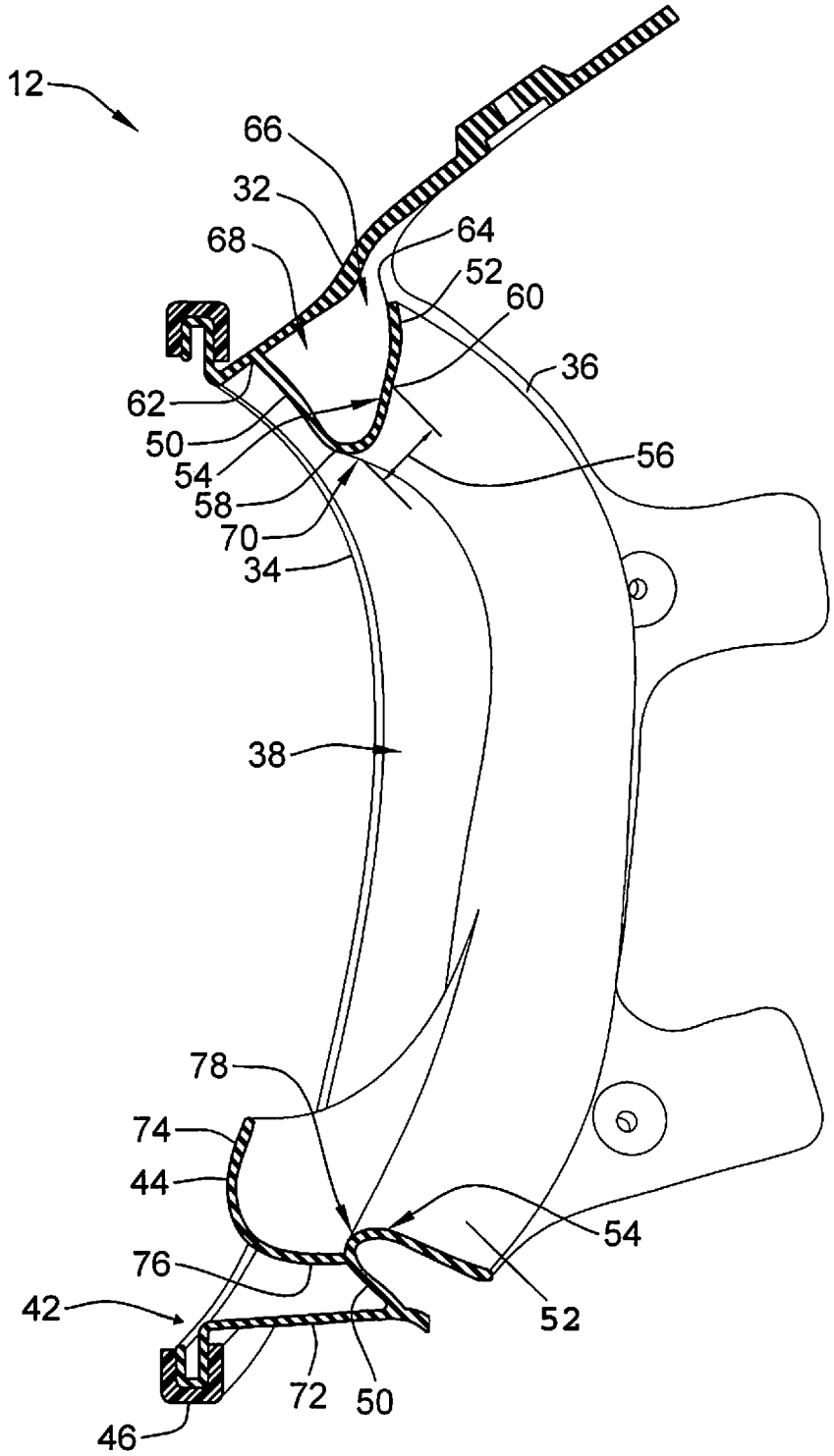
FIG. 4 is a cross sectional view of the face seal shown in FIG. 3.

FIG. 4 is a cross sectional view of the face seal 30 with other portions of the mask 12 removed for clarity. The face seal 30 is configured to extend entirely circumferentially around the user's face to completely seal the chamber 38. The face seal 30 is composed of different regions that engage different portions of the user's face, such as a forehead region, a temple region, a cheek region, and a chin region, each of which engage corresponding portions of the user's face.

The body 32 extends between the front edge 34 and the rear edge 36. A bezel 46 is provided at the front edge 34 and surrounds the opening 42. In an exemplary embodiment, the bezel 46 is a separate frame component attached to the body 32 and includes a circumferential groove that receives the lens 14 (shown in FIG. 1). Alternatively, the body 32 may be folded over to form the bezel 46.

The face seal 30 includes a first wall 50 and a second wall 52 intersecting with the first wall 50 at a sealing land 54. The sealing land 54 is the portion of the face seal 30 that contacts the user's face to form the continuous circumferential seal around the user's face. The first wall 50, second wall 52, and sealing land 54 are integrally formed with one another and define different portions of the face seal 30 with the sealing land 54 spanning between the first and second walls 50, 52. The first wall 50 intersects with the sealing land 54 at a front end 58 thereof and the second wall 52 intersects with the sealing land 54 at a rear end 60 thereof. The sealing land 54 is held away from the body 32 by the first and second walls 50, 52, and the first and second walls 50, 52 are spaced apart from one another to separately support the front end 58 and the rear end 60, respectively.

The sealing land 54 has a width 56 measured between the front end 58 and the rear end 60, where the front end 58 is positioned forward of the rear end 60 on the user's face. The width 56 may not be uniform or the same along different portions of the face seal 30. For example, the width 56 at the chin region may be different than the width 56 at the temple region. The width 56 may change as the mask 12 is worn. For example, the width 56 at the chin region may change as the user's mouth opens and closes. The width 56 may change as the user inhales or exhales, however the width 56 may be sufficient to prevent transfer of external air across the seal barrier under pressures due to breathing and to accommodate changes in pressure during inhalation and exhalation to continuously maintain a seal. The air can only be pulled so far across the sealing land 54 (e.g. less than the entire width 56) with inhalation pressure to prevent the seal from being breached by external air.

The first wall 50 extends from the sealing land 54 toward the body 32 to a first end 62 of the face seal 30. The second wall 52 extends from the sealing land 54 toward the body 32 to a second end 64 of the face seal 30. In an exemplary embodiment, the first end 62 is secured to the body 32, such as by being integrally formed with the body 32. The face seal 30 is cantilevered from the body 32 such that the second wall 52 is free from the body 32 and not permanently mechanically secured to the body 32. The second wall 52 is configured to be pressed against the body 32 and/or the first wall 50 when the face seal 30 engages the user's face such that the sealing land 54 is supported by both the first and second walls 50, 52 against the body 32. For example, when the face seal 30 engages the user's face, the face seal 30 is forced generally outward. The second wall 52 is likewise forced outward until the second wall 52 engages the body 32 and/or the first wall 50. Optionally, the second end 64, or a portion of the second wall 52 near the second end 64, engages the body 32 and/or the first wall 50. In alternative embodiments, both the first and second walls 50, 52 may be mechanically secured to the body 32, or only the second wall 52 may be mechanically secured to the body 32 while the first wall 50 is free from the body 32. The first and second walls 50, 52 operate as spring elements to support the sealing land 54. For example, the first and second walls 50, 52 may be resiliently deflected when the mask 12 is donned such that the first and second walls 50, 52 spring inward towards the user's face. As such, the sealing land 54 may be spring biased against the user's face to maintain a continuous circumferential seal around the user's face. The spring nature of the U-shape allows the mask 12 to accommodate a wider range of face sizes and shapes.

The first and second walls 50, 52 may be moved independently with respect to one another and with respect to the sealing land 54 and/or with respect to the body 32. As such, the sealing land 54 is capable of maintaining a seal against the user's face even if the first wall 50 and/or the second wall 52 are stretched or flexed during donning and/or wearing of the mask 12. The position of the sealing land 54 along the face seal 30 may change as the mask 12 is donned, tightened or worn, however, the seal of the sealing land 54 is not disrupted because the first and second walls 50, 52 are capable of moving independently and are spring biased against the user's face.

In the illustrated embodiment, the face seal 30 is rolled or folded over such that the face seal 30 has a bulbous shape, which in one embodiment is generally U-shaped, with the first and second walls 50, 52 surrounding a seal cavity 66. The fold defines an edge which is generally the inner-most portion of the face seal 30. The edge may be the portion of the face seal 30 that engages the user's face. The first and second walls 50, 52 are spaced apart from one another to form the seal cavity 66. The seal cavity 66 is bounded by the first and second walls 50, 52, the sealing land 54 and the body 32. The first and second walls 50, 52 form the legs of the U-shaped face seal 30 that extend between opposed sides, with one of the sides being an open side 68 and the other side being a closed side 70. The open side 68 is positioned outward of the closed side 70, such as proximate to the body 32, and the closed side 70 is positioned inward of the open side 68 for engagement with the user's face. The closed side 70 may represent the folded over portion of the facing seal 30. The closed side 70 may be defined, at least in part, by the first wall 50, the second wall 52 and/or the sealing land 54. The closed side 70 is held away from the body 32 by the first and second walls 50, 52. Optionally, the closed side 70 may engage the user's face when the mask 12 is donned.

The chin cup 44 is provided near a bottom 72 of the body 32. Optionally, the chin cup 44 may be coupled to the face seal 30 along the chin region and the cheek region. The chin cup 44 forms a pocket that receives the user's chin. The chin cup 44 has a front 74 and a bottom 76. The transition between the front 74 and bottom 76 is curved to accommodate the chin. A top of the front 74 may be angled slightly rearward to follow the contour of the chin toward the lower lip and/or to securely hold the chin. The bottom 76 is spaced apart from the bottom 72 of the body 32. The bottom 76 is secured to a portion of the face seal 30. For example, the chin cup 44 may be integrally formed with the face seal 30 such that the bottom 76 of the chin cup 44 extends from the face seal 30.

In an exemplary embodiment, a portion of the face seal 30 extends inward with respect to the bottom 76. The face seal 30 is rolled upward above the bottom 76 to form a lip 78 between the chin cup 44 and the face seal 30. The interface between the chin cup 44 and the face seal 30 is adapted to capture the chin therein. The lip 78 is raised above the bottom 76 to actively capture the chin to prevent the chin from slipping out of the sealed area of the mask 12. The chin cup 44 and the lip 78 of the face seal 30 constitute a ball detent for capturing the chin. For example, the lip 78 cooperates with the chin cup 44 to form a detent feature, while the chin acts as the ball. Once the chin is seated in the chin cup 44, the lip 78 captures the chin and jaw and moves with the chin and jaw. The lip 78 does not allow the chin to slip out of the chin cup 44. In an exemplary embodiment, the face seal 30 faces forward toward the pocket of the chin cup 44 so that the face seal 30 provides a spring force against the chin and/or the jaw bone.

Figure 5:
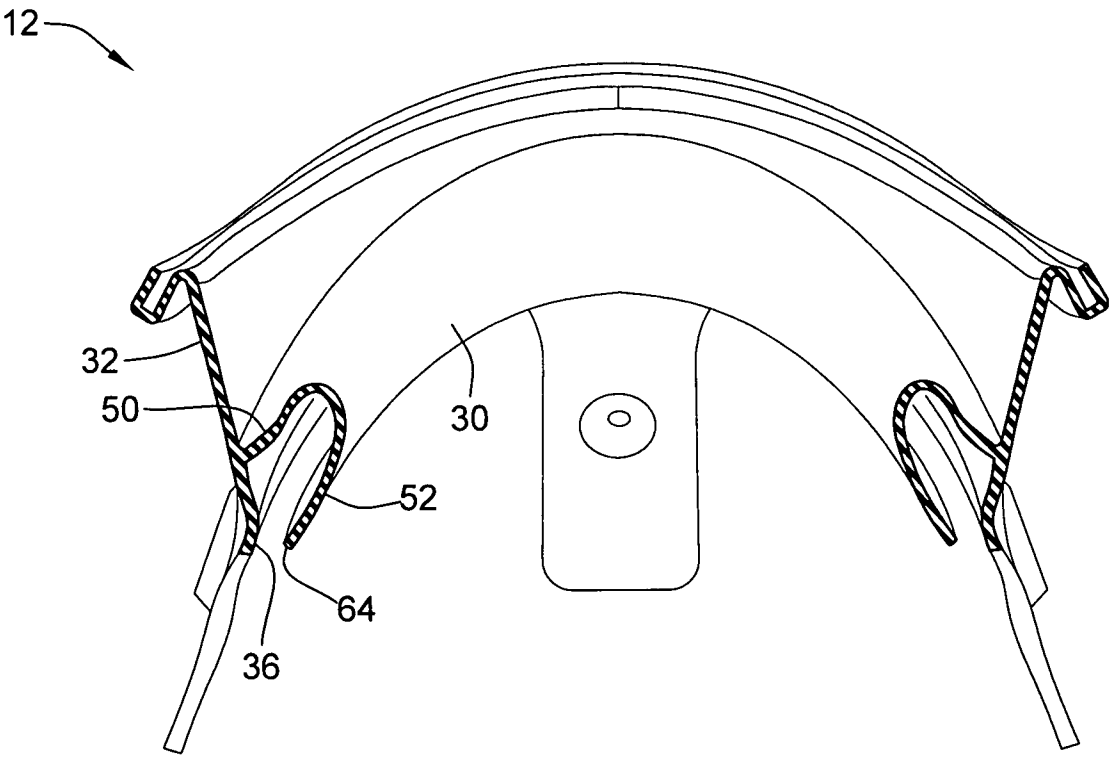
FIG. 5 is another cross sectional view of the face seal shown in FIG. 3.

FIG. 5 is another cross sectional view of a portion of the mask 12 showing the face seal 30 taken generally along the cheek region of the face seal 30 and illustrating the top portion of the mask 12 and face seal 30. FIG. 5 illustrates the first wall 50 of the face seal 30 extending from the body 32. The face seal 30 is folded over such that the second wall 52 extends generally parallel to the first wall 50. The second end 64 of the second wall 52 is positioned near the rear edge 36. The second end 64 may be deflected toward the body 32 when the mask 12 is donned and the face seal 30 is deformed by the sealing engagement with the user's face.

Figure 6:
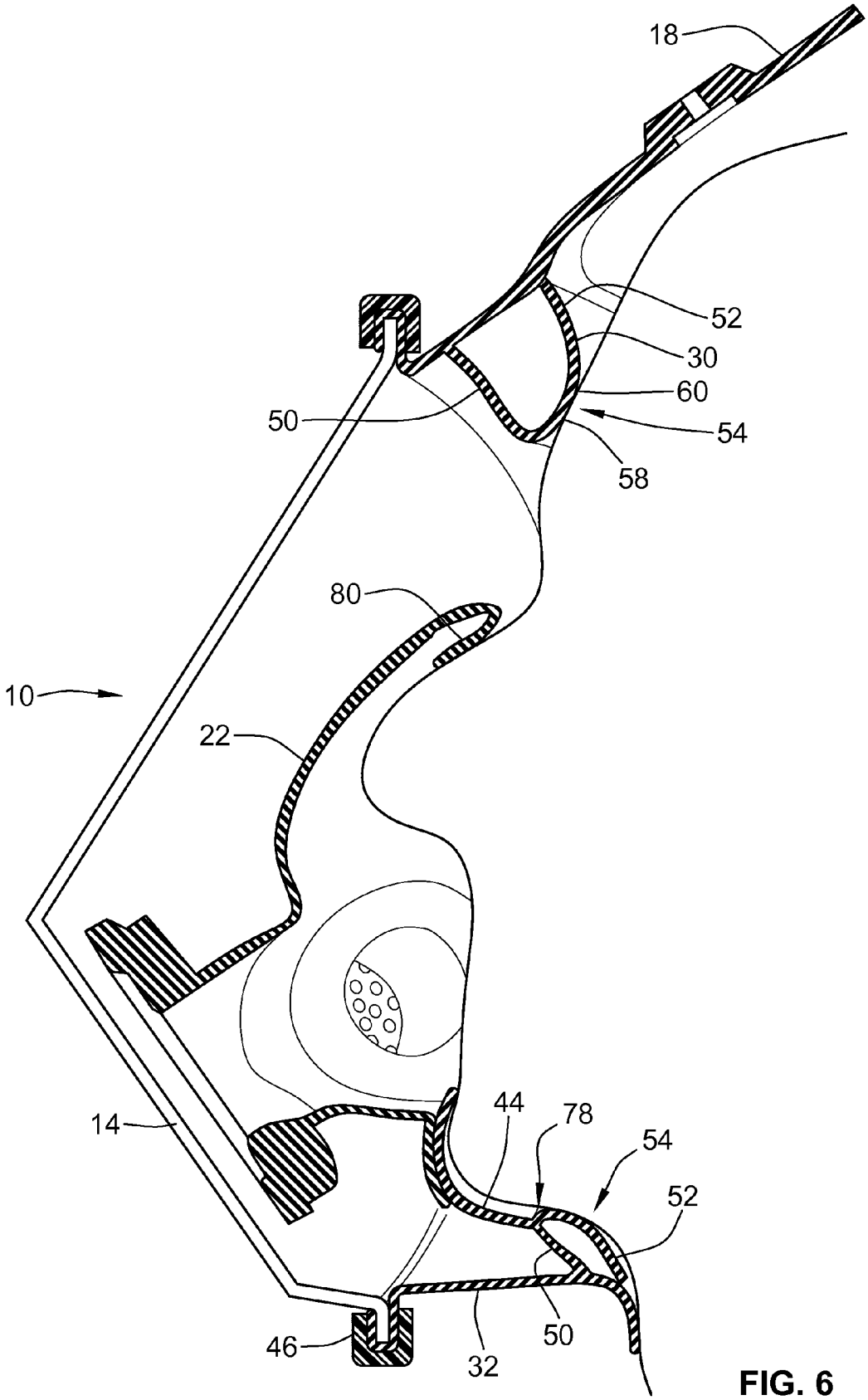
FIG. 6 illustrates a portion of the respirator as the respirator is worn by a user.

FIG. 6 is a partial cross sectional view illustrating a portion of the respirator 10 worn by a user with the cartridge 16 (shown in FIG. 1) removed for clarity and showing the face seal 30 sealing against the users face. The lens 14 is coupled to the bezel 46 and the body 32. The nose cup 22 surrounds the user's nose and mouth. The nose cup 22 includes a seal 80 that seals against the user's face. A portion of the seal 80 engages the chin cup 44. Optionally, the nose cup may be integrally formed with the chin cup 44, the body 32 and/or the face seal 30.

When the mask is donned, the face seal 30 seals against the user's face. The face seal 30 provides a continuous circumferential seal. The sealing land 54 is the portion of the face seal 30 that engages the user's face. FIG. 6 illustrates the forehead region of the sealing land 54 engaging the user's forehead and the chin region of the sealing land 54 engaging the user's chin. The user's chin is received within the pocket of the chin cup 44 and the chin sits in front of the lip 78. The lip 78 is rolled up tinder the user's chin to capture the chin within the pocket. The chin is captured all around by the face seal 30 and the chin cup 44, such as under the chin, in front of the chin to under the lip, around the jaw and along the cheeks. Because the chin cup 44 is secured to the face seal 30, the chin cup 44 helps maintain the integrity of the seal between the sealing land 54 and the users face.

The folded over design of the face seal 30 generally forces the face seal 30 inward toward the user's face. The face seal 30 is pressed against the body 32 such that both the first and second walls 50, 52 support the sealing land 54. When the first and second walls 50, 52 of the face seal 30 are compressed or deformed, such as when the sealing land 54 engages the user's face, the first and second walls 50, 52 act as spring elements that provide a biasing force against the user's face. Such biasing or spring force maintains the seal against the user's face, which increases the fit factor and the integrity of the respirator 10. The sealing land 54 conforms to the user's face for better sealing, more comfort and higher fit factors.

The body 32 is attached to the head harness 18 (a portion of which is shown in FIG. 6). As a result, the body 32 may be deformed, such as by being stretched as the head harness 18 is tightened. However, with the face seal 30 acting as a separate structure from the body 32, the face seal 30 is not distorted or wrinkled when head harness 18 is tightened and/or when the body 32 is deformed. As a result, the sealing land 54 is not distorted or wrinkled, which may improve the fit factor and/or security of the seal.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the Hull scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A respirator comprising:

a mask having a body extending between a front edge and a rear edge, the body configured to surround a chin, mouth, nose, and eyes of a user's face;

a face seal extending inward from the body, the face seal having a first wall extending from the body and a second wall intersecting with the first wall at a sealing land, the sealing land being configured to contact the user's face to form a continuous circumferential seal, the face seal being folded over such that the first wall and the second wall both extend away from the sealing land in a common direction, wherein the second wall extends away from the sealing land to a free end, and wherein the free end of the second wall is disengaged from the mask body and the first wall when the sealing land is not in contact with the user's face, the free end of the second wall being configured to be pressed into engagement with the mask body as the sealing land is contacted with the user's face; and a chin cup extending from the first wall of the face seal, the chin cup configured to receive the chin of the user's face therein.

2. The respirator of claim 1, wherein the face seal is U-shaped having an open side and a closed side, the open side being positioned outward with respect to the closed side.

3. The respirator of claim 1, wherein the face seal is cantilevered from the body with the first wall extending inward from the body to the sealing land and with the second wall extending from the sealing land outward toward the body.

4. The respirator of claim 1, wherein the first and second walls are spaced apart from one another to form a seal cavity generally bounded by the first and second walls, the sealing land and the body.

5. The respirator of claim 1, wherein the chin cup has a bottom and a front, the bottom extending from the face seal and configured to extend under the chin of the user's face, the front extending from the bottom and configured to extend in front of the chin, the face seal extending inward from the bottom of the chin cup.

6. The respirator of claim 1, wherein the chin cup has a bottom configured to extend under the chin of the user's face, the face seal being rolled upward above the bottom of the chin cup to form a lip rearward of the chin cup, the lip configured to capture the chin in the chin cup.

7. The respirator of claim 1, wherein the face seal is cantilevered from the body, the free end of the second wall being configured to be pressed against the body when the face seal engages the user's face such that the sealing land is supported by both the first and second walls.

8. The respirator of claim 1, further comprising a nose cup coupled to the mask, the nose cup being configured to seal around the user's nose and mouth.

9. The respirator of claim 1, wherein the free end of the second wall is disengaged from every other portion of the face seal when the sealing land is not in contact with the user's face.

10. A face seal for a respirator mask, the face seal comprising:

a first wall extending inward from the mask to an end of the first wall;

a chin cup extending forward from the first wall, the chin cup configured to receive the chin of a user's face therein;

a sealing land at the end of the first wall, the sealing land being configured to surround a chin, mouth, nose, and eyes of the user's face and to contact the user's face to form a continuous circumferential seal against the user's face, the sealing land having a front end and a rear end where the front end is positioned forward of the rear end on the user's face; and a second wall extending outward from the sealing land to a free end of the second wall, wherein the free end of the second wall is disengaged from the mask and the first wall when the sealing land is not in contact with the user's face, the free end of the second wall being configured to be pressed into engagement with the mask as the sealing land is contacted with the user's face;

wherein the first wall, sealing land, and second wall are integrally formed and define a U-shaped face seal configured to seal against the user's face.

11. The face seal of claim 10, wherein the first wall extends from the front end of the sealing land toward the mask and the second wall extends from the rear end of the sealing land toward the mask.

12. The face seal of claim 10, wherein the first and second walls are configured to engage the mask remote from one another, the sealing land being supported by the first and second walls away from the mask, the sealing land being configured to exert a spring force against the user's face with both the first and second walls defining spring elements for the face seal.

13. The face seal of claim 10, wherein the chin cup has a bottom and a front, the bottom extending forward from the first wall and configured to extend under the chin of the user's face, the front extending from the bottom and configured to extend in front of the chin, the sealing land located rearward of the bottom of the chin cup and extending inward relative to the bottom of the chin cup.

14. The face seal of claim 10, wherein the free end of the second wall is disengaged from every other portion of the face seal when the sealing land is not in contact with the user's face.

15. The face seal of claim 10, wherein the chin cup has a bottom configured to extend under the chin of the user, the sealing land being rolled upward above the bottom of the chin cup to form a lip rearward of the chin cup, the lip configured to capture the chin in the chin cup.

16. A method of manufacturing a respirator, the method comprising:

forming a mask body configured to be worn by a user, the mask body configured to surround a chin, mouth, nose, and eyes of the user's face;

positioning a face seal inward of the mask body, the face seal having a first wall, a second wall, a sealing land between the first and second walls, and a chin cup extending from the first wall, the chin cup configured to receive the chin of the user's face therein, the second wall extending from the sealing land to a free end of the second wall, the face seal being folded over to define a bulbous shape adapted for engaging the user's face; and securing an end of the first wall to the mask body and allowing the free end of the second wall to be free from the mask body, wherein the free end of the second wall is configured to engage the mask body when the mask is worn by the user such that the face seal is supported at two different points along the mask body.

17. The method of claim 16, further comprising positioning the face seal such that sealing land is spring biased against the user's face.

18. The method of claim 16, wherein the chin cup has a bottom and a front, the bottom configured to extend along a bottom of the user's chin, the front extending from the bottom and configured to extend along a front of the user's chin; the method further comprising:

securing the chin cup to the first wall of the face seal such that the sealing land is positioned inward with respect to the bottom of the chin cup.

19. The method of claim 16, wherein the chin cup has a bottom configured to extend under the chin of the user, the sealing land being rolled upward above the bottom of the chin cup to form a lip rearward of the chin cup, the lip configured to capture the chin in the chin cup.

* * * * *